United States Patent [19]

Crawford

[11] Patent Number: 4,954,749

[45] Date of Patent: Sep. 4, 1990

[54] FLUORESCENT LAMP ELECTRODE DISCONNECT METHOD AND ARRANGEMENT FOR PRACTICING THE METHOD

[75] Inventor: Joseph A. Crawford, Chicago, Ill.

[73] Assignee: North American Philips Corporation, New York, N.Y.

[21] Appl. No.: 271,557

[22] Filed: Nov. 15, 1988

[51] Int. Cl.[5] ..... H05B 41/00

[52] U.S. Cl. ..... 315/97; 315/106/DIG. 5

[58] Field of Search ..... 315/94, 97, 106, 107, 315/DIG. 5

[56] References Cited

U.S. PATENT DOCUMENTS

| | | | |
|---|---|---|---|
| 2,317,602 | 4/1943 | Hall, Jr. et al. . | |
| 2,330,312 | 9/1943 | Raney, Jr. . | |
| 2,668,259 | 2/1954 | Stutsman . | |
| 3,866,087 | 2/1975 | Powell . | |
| 4,152,628 | 5/1979 | Rottier . | |
| 4,256,993 | 3/1981 | Morton . | |
| 4,339,690 | 7/1982 | Regan et al. | 315/106 X |
| 4,353,011 | 10/1982 | Kaneda . | |
| 4,399,391 | 8/1983 | Hammer et al. | 315/106 X |
| 4,425,530 | 1/1984 | Hammer et al. . | |
| 4,603,281 | 7/1986 | Nilssen | 315/106 |
| 4,661,745 | 4/1987 | Citino et al. | 315/106 |

*Primary Examiner*—Robert J. Pascal

*Attorney, Agent, or Firm*—Robert T. Mayer

[57] ABSTRACT

A fluorescent lamp system including a relay whose coil is connected across the secondary of the transformer of the system and whose contacts interrupt the connection of the electrodes of the lamp system to their associated heater windings after lamp turn on.

21 Claims, 1 Drawing Sheet

FLUORESCENT LAMP ELECTRODE DISCONNECT METHOD AND ARRANGEMENT FOR PRACTICING THE METHOD

BACKGROUND OF THE INVENTION

This is an invention in lighting. More particularly it involves an arrangement for decreasing the power expended in fluorescent lamp systems.

It is desirable in fluorescent lamp systems to save power by shutting off the current to the heater electrodes after ignition. A number of arrangements for doing this have been suggested in the past. Some of these involve complicated circuitry and are costly. Others respond to a time delay after the heater electrodes are energized and do not ensure lamp operation.

SUMMARY OF THE INVENTION

It is an object of this invention to provide an arrangement for discontinuing heater electrode current flow in fluorescent lamps after the lamps are ignited.

One of the features of the invention is that it responds to an increase in voltage in a fluorescent lamp system which only takes place after lamp ignition.

One of the advantages of the invention is that the circuitry involved in accomplishing the above object is simple and straight forward.

In accordance with one embodiment of the invention, there is provided a rapid start fluorescent lamp system comprising a plurality of fluorescent lamps each having a pair of electrodes. A ballast is provided for connection to a source of voltage. The ballast includes a primary winding, a secondary winding and a plurality of electrode windings for connection to the electrodes. Disconnecting means is also provided which is connected in parallel with the secondary winding. The disconnecting means is responsive to the voltage across the secondary winding when the plurality of lamps turn on and interrupts the connection of the electrodes to the electrode windings.

In accordance with another aspect of the invention, there is provided a rapid start fluorescent lamp system comprising a plurality of fluorescent lamps each having a pair of electrodes. A ballast is provided for connection to a source of voltage. The ballast includes a primary winding, a secondary winding and a plurality of electrode windings for applying heating voltage to the electrodes. Disconnecting means are provided which are connected in parallel with the secondary winding. The disconnecting means is responsive to the decrease in voltage across the secondary winding when the plurality of lamps turn on for interrupting the heating voltage applied to the electrodes.

In accordance with still another aspect of the invention, there is provided a rapid start fluorescent lamp system comprising a plurality of fluorescent lamps each having a pair of electrodes. A ballast is provided for connection to a source of voltage. The ballast includes a primary winding, a secondary winding and a plurality of electrode windings for applying heating voltage to the electrodes. Disconnecting means are provided which are connected in parallel with the secondary winding. The disconnecting means is responsive to the decrease in voltage across the secondary winding when the plurality of lamps turn on for interrupting the heating voltage applied to the electrodes.

Other objects, features and advantages of the invention will be apparent from the following description and appended claims when considered in conjunction with the accompanying drawings.

DESCRIPTION OF THE PREFERRED EMBODIMENTS

Figure 1:
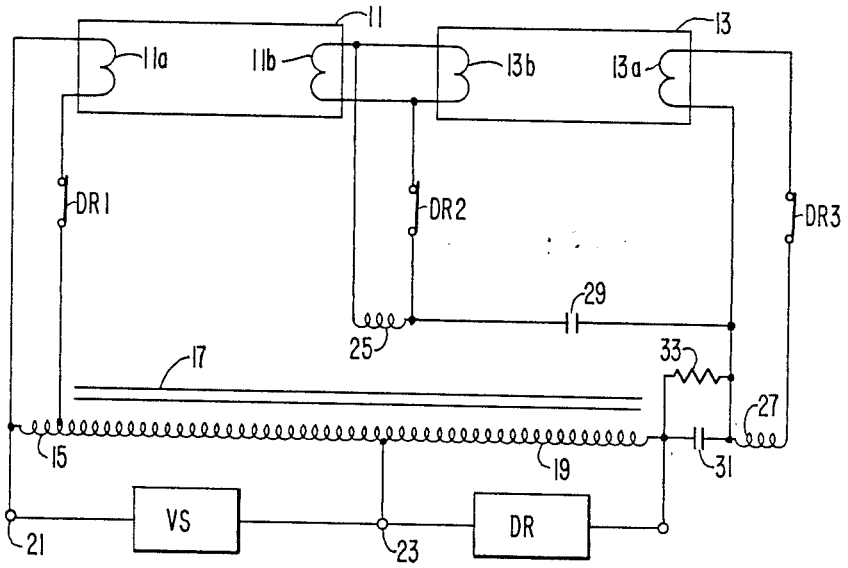
FIG. 1 is a schematic circuit diagram of a so-called two lamp rapid start fluorescent system embodying the features of the invention with a leading power factor auto-transformer.

Referring specifically to FIG. 1, there is shown therein two fluorescent lamps 11 and 13 each having a pair of electrodes 11*a*, 11*b* and 13*a*, 13*b*, respectively. As is typical, electrode 11*a* is connected across winding 15 of auto-transformer 17. Connected in one line from electrode 11*a* to winding 15 is normally closed contact DR1 of a disconnect means in the form of a relay whose coil is identified on the drawing by the box with the reference characters DR in it. Coil DR is connected for energization across the secondary 19 of auto-transformer 17. Terminals 21 and 23 serve to permit the primary of auto-transformer 17 to be connected to an appropriate source of voltage VS.

Electrodes 11*b* and 13*b* of lamps 11 and 13 are connected in parallel and both are connected across heater winding 25. Connected in one of the lines from elements 11*b* and 13*b* to winding 25 are contacts DR2 of the disconnect relay.

Electrode 13*a* of lamp 13 is connected across heater winding 27. Contacts DR3 of the disconnect relay are connected in one of the lines from electrode 13*a* to winding 27. Connected between the other line from electrode 13*a* to winding 27 is one end of starting capacitor 29. The other end of starting capacitor 29 is connected to one end of heater winding 25.

Connected between secondary winding 19 and heating winding 27 is power capacitor 31 and its bleeder resistance 33.

A constructed embodiment of the invention employed two 40 watt, T12, rapid start lamps. The application of a 120 volt, 60 cycle source across terminals 21 and 23 induces a starting voltage across lamp 11 by reason of starting capacitor 29. This causes lamp 11 to turn on. When this occurs, the impedance of lamp 11 decreases sufficiently to cause a starting voltage to be applied across lamp 13 and it also turns on. When both lamps are fully operational, the voltage across secondary winding 19, which before the lamps were turned on was 163 volts, increases to 192 volts. This increase in voltage appears across coil DR and causes the disconnect relay (which in the constructed embodiment was a Potter and Bromfield part No. KH-6378-1) to operate to open contacts DR1, DR2 and DR3. As a consequence, all current to electrodes 11*a*, 11*b*, 13*a*, and 13*b* is discontinued. In this way the disconnect relay serves as a disconnect means for interrupting the connection of the electrodes to the heater windings.

Figure 2:
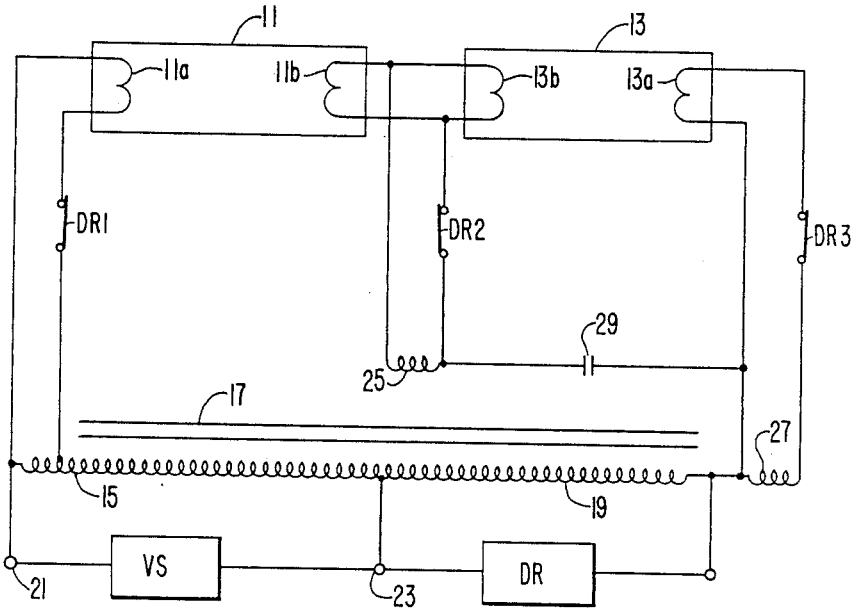
FIG. 2 is a schematic circuit diagram of a so-called two lamp rapid start fluorescent system embodying the features of the invention with a lagging power factor auto-transformer.

In the lag version of the invention shown in FIG. 2 corresponding elements to those of FIG. 1 are identified by the same reference characters. As those skilled in the art will understand with a lag auto-transformer the voltage across the secondary decreases when the lamps turn on. As a result, the disconnect relay in the FIG. 2 embodiment is one which drops out to open contacts DR1, DR2 and DR3 when the voltage across coil DR decreases as opposed to the disconnect relay of the FIG. 1 embodiment which pulls in to open contacts DR1, DR2 and DR3 of FIG. 1.

As those skilled in the art will appreciate, while only two types of ballast arrangements have been specifically disclosed herein the invention described will operate with various other ballast arrangements in which the voltage across a secondary winding changes as the result of lamp turn on.

It should be apparent that modification of the above will be evident to those skilled in the art and that the arrangements described herein are for illustrative purposes and are not to be considered restrictive.

What is claimed is:

1. A rapid start fluorescent lamp system comprising, a plurality of fluorescent lamps each having a pair of electrodes, a ballast for connection to a source of voltage, said ballast including a primary winding, a secondary winding and a plurality of electrode windings connected to said electrodes, and disconnect means connected in parallel with said secondary winding, said disconnect means being responsive to the voltage across said secondary winding when said plurality of lamps turn on for interrupting the connection of each of said electrodes to its respective electrode winding.

2. A rapid start fluorescent lamp system as claimed in claim 1, wherein said disconnect means comprises a relay.

3. A rapid start fluorescent lamp system as claimed in claim 2, wherein said relay includes contact means between each of said electrodes and its associated electrode winding.

4. A rapid start fluorescent lamp system comprising, a plurality of fluorescent lamps each having a pair of electrodes, a ballast for connection to a source of voltage, said ballast including a primary winding, a secondary winding and a plurality of heater windings for applying heating voltage to said electrodes, and disconnect means connected in parallel with said secondary winding, said disconnect means being responsive to the decrease in voltage across said secondary winding when said plurality of lamps turn on for interrupting the heating voltage applied to said electrodes.

5. A rapid start fluorescent lamp system as claimed in claim 4, wherein said disconnect means comprises a relay.

6. A rapid start fluorescent lamp system as claimed in claim 5, wherein said relay includes contact means between each of said electrodes and its associated heater winding.

7. A method for disconnecting electrodes of fluorescent lamps from their heater voltages in a rapid start fluorescent lamp system including a voltage source and a ballast across said voltage source, said ballast having a primary, a secondary and a plurality of electrode windings, said method including sensing the voltage decrease across said secondary when said lamps turn on and interrupting each of said heater voltages in response to said sensing.

8. A method as in claim 7, wherein said sensing includes energizing the coil of a relay.

9. A method as in claim 8, wherein said interrupting includes opening a pair of closed contacts of said relay for each of said electrodes.

10. A rapid start fluorescent lamp system comprising, a plurality of fluorescent lamps each having a pair of electrodes, a ballast for connection to a source of voltage, said ballast including a primary winding, a secondary winding and a plurality of heater windings for applying heating voltage to said electrodes, and disconnect means connected in parallel with said secondary winding, said disconnect means being responsive to the decrease in voltage across said secondary winding when said plurality of lamps turn on for interrupting the heating voltage applied to each of said electrodes.

11. A rapid start fluorescent lamp system as claimed in claim 10, wherein said disconnect means comprises a relay.

12. A rapid start fluorescent lamp system as claimed in claim 11, wherein said relay includes contact means between each of said electrodes and its associated heater winding.

13. A method for disconnecting electrodes of fluorescent lamps from their heater voltages in a rapid start fluorescent lamp system including a voltage source and a ballast across said voltage source, said ballast having a primary, a secondary and a plurality of electrode windings, said method including sensing the voltage decrease across said secondary when said lamps turn on and interrupting each of said heater voltages in response to said sensing.

14. A method as in claim 13, wherein said sensing includes energizing the coil of a relay.

15. A method as in claim 14, wherein said interrupting includes opening a pair of closed contacts of said relay for each of said electrodes.

16. A fluorescent lamp system comprising, at least one fluorescent lamp having a pair of electrodes, a ballast for connection to a source of voltage, said ballast including a primary winding, a secondary winding and a plurality of element windings connected to said electrodes of each said fluorescent lamp, and disconnect means connected in parallel with said secondary winding, said disconnect means being responsive to the voltage across said secondary winding when said at least one lamp turns on for interrupting the connection of each of said electrodes to its respective electrode winding.

17. A rapid start fluorescent lamp system as claimed in claim 16, wherein said disconnect means comprises a relay.

18. A rapid start fluorescent lamp system as claimed in claim 17, wherein said relay includes contact means between each of said electrodes and its associated electrode winding.

19. A method for disconnecting electrodes of at least one fluorescent lamp from their heater voltages in a fluorescent lamp system including a voltage source and a ballast across said voltage source, said ballast having a primary, a secondary and a plurality of electrode windings, said method including sensing the voltage decrease across said secondary when said at least one lamp turns on and interrupting each of said heater voltages in response to said sensing.

20. A method as in claim 19, wherein said sensing includes energizing the coil of a relay.

21. A method as in claim 20, wherein said interrupting includes opening a pair of closed contacts of said relay for each of said electrodes.

* * * * *